US005144761A

United States Patent [19]

Fitzwater

[11] Patent Number: 5,144,761

[45] Date of Patent: Sep. 8, 1992

[54] FRONT END LOADER-MOUNTED DITCH HOE ATTACHMENT

[76] Inventor: Garland J. Fitzwater, P.O. Box 126, Protection, Kans. 67127

[21] Appl. No.: 781,890

[22] Filed: Oct. 24, 1991

[51] Int. Cl.[5] ..... E02F 3/76

[52] U.S. Cl. ..... 37/117.5; 37/DIG. 9; 37/118 R; 414/722

[58] Field of Search ..... 37/117.5, 80 R, 103, 37/118 R, DIG. 5, DIG. 6, DIG. 9; 172/817; 414/724, 722, 727, 694, 912

[56] References Cited

U.S. PATENT DOCUMENTS

| | | | |
|---|---|---|---|
| 2,470,147 | 5/1949 | Cramer | 414/707 |
| 2,742,165 | 4/1956 | Pilch | 414/694 |
| 2,881,932 | 4/1959 | Schwing . | |
| 2,992,016 | 7/1961 | Pilch | 414/694 |
| 3,042,236 | 7/1962 | Pilch | 74/105 |
| 3,107,799 | 10/1963 | Briscoe et al. | 414/726 |
| 3,286,377 | 11/1966 | Long | 37/118 |
| 3,626,612 | 12/1971 | Liebrecht | 37/118 |
| 3,732,996 | 5/1973 | Bauer | 414/786 |
| 3,802,586 | 4/1974 | Lofgreen | 414/722 |
| 3,887,096 | 6/1975 | Wieland . | |
| 3,922,745 | 12/1975 | Lehman | 15/87 |
| 4,142,308 | 3/1979 | Brandtjen | 414/694 |
| 4,264,264 | 4/1981 | McMillan et al. | 414/686 |
| 4,383,793 | 5/1983 | Weir | 414/686 |
| 4,541,161 | 9/1985 | Shimoie | 29/401.1 |
| 4,848,012 | 7/1989 | Zimmerman | 37/117.5 |
| 4,890,400 | 1/1990 | Long | 37/117.5 |
| 4,999,022 | 3/1991 | Veys | 414/718 |

FOREIGN PATENT DOCUMENTS

| | | | |
|---|---|---|---|
| 1233423 | 8/1958 | France | 37/103 |
| 464095 | 11/1968 | Switzerland | 37/103 |
| 1049307 | 11/1966 | United Kingdom | 37/103 |

*Primary Examiner*—Randolph A. Reese
*Assistant Examiner*—Spencer Warnick
*Attorney, Agent, or Firm*—John R. Flanagan

[57] ABSTRACT

A ditch hoe attachment has an attaching frame, an elongated arm, a scoop, and first and second actuators. The frame is attachable to a tractor-mounted front end loader and has a cross tube mounted for rotation about a first rotational axis and a crank lever attached to the cross tube for rotation therewith and extending radially therefrom. The elongated arm has a rear portion rigidly attached to the cross tube, and a front portion mounted to the rear portion for rotation relative thereto about a second rotational axis. The scoop is fixedly mounted to the outer end of the front portion of the elongated arm. The first actuator is mounted between the frame and crank arm and operable through forward and reverse strokes to rotate the cross tube and rear portion of the arm from forward to rearward positions and back to the forward position. The second actuator is mounted between the cross tube and front portion of the arm and operable through forward and reverse strokes to rotate the front portion relative to the rear portion of the arm from aligned to transverse positions and back to the aligned position. The first and second rotational axes are oriented transversely to one another such that successive operation of the first and second actuators through their forward and reverse strokes moves the scoop along a rearward loading path followed by a forward unloading path being laterally offset from the rearward loading path.

12 Claims, 4 Drawing Sheets

FRONT END LOADER-MOUNTED DITCH HOE ATTACHMENT

BACKGROUND OF THE INVENTION

1. Field of the Invention

The present invention generally relates to digging implements and, more particularly, is concerned with a ditch hoe attachment mountable to the boom structure of a tractor front end loader attachment.

2. Description of the Prior Art

In many farming and ranching operations it is common practice to employ a small tractor to do general utility work. Typically, an implement commonly known as a front end loader attachment is kept mounted on this tractor at all times to be available when frequently needed to perform various tasks, such as lifting and moving heavy loads. Although many tasks can be performed using a front end loader, there are still other tasks which require the use of a different implement. Various other implements have been provided to perform these other tasks. Typical of other implements are those commonly referred to as a back hoe attachment and a scraper blade attachment for mounting to the rear of the tractor, and a dozer blade attachment for mounting to the front of the tractor.

As with the front end loader, each of these other implements ordinarily employs a separate boom structure for mounting to the tractor and a working tool supported from the boom structure. As a result, each attachment is typically of substantial size and weight and thus costly to acquire. The infrequency of use of some of these other implements, such as a back hoe, compared to a front end loader, makes it difficult to justify the substantial expenditure to acquire them. Therefore, when the need does arise to use a back hoe for example, either a custom operator must be hired or the implement must be rented for the time needed to accomplish the task. In some regions, neither of these services are readily available.

Consequently, a need exists for an implement which can perform excavating or digging in a similar manner to that of a conventional back hoe, but which is lightweight and substantially less costly to acquire and thus to have on-hand when needed.

SUMMARY OF THE INVENTION

The present invention provides a front end loader-mounted ditch hoe attachment designed to satisfy this need. In accordance with the present invention, the ditch hoe attachment basically includes an attaching frame, an elongated arm, a working tool such as an excavating or digging scoop, and a pair of first and second actuators.

The attaching frame of the ditch hoe attachment defines a first rotational axis and includes a first member mounted for rotation about the first rotational axis. The attaching frame also includes a second member attached to the first member and extending therefrom in a radial relation to the first rotational axis.

The elongated arm of the ditch hoe attachment has a rear portion rigidly attached to the first member of the attaching frame and a front portion supported by the rear portion. The rear portion of the elongated arm is mounted for rotational movement with the first member of the attaching frame. The front portion is mounted to the rear portion for pivotal movement relative to the rear portion about a second rotational axis. The scoop is fixedly mounted to the outer end of the front portion of the elongated arm and is capable of digging into and filling with earth.

The first actuator of the ditch hoe attachment is mounted between the attaching frame and the first member thereof. The first actuator is operable through forward and reverse strokes to rotate the first member and rear portion of the elongated arm therewith respectively from a forward to rearward position and back to the forward position.

The second actuator of the ditch hoe attachment is mounted between the first member of the attaching frame and the front portion of the elongated arm. The second actuator is operable through forward and reverse strokes to rotate the front portion of the elongated arm relative to the rear portion thereof respectively from an aligned position relative to the rear portion of the elongated arm to a transverse position relative thereto and back to the aligned position.

The first and second rotational axes are oriented in a generally transverse relation to one another. Due to such orientation of the first and second rotational axes, successive operation of the first and second actuators through their respective forward strokes will move the scoop from an initial position along a rearward loading path in which the scoop digs the ground and fills with earth. Then, successive operation of the first and second actuators through their respective reverse strokes will move the scoop along a forward unloading path and back to its initial position. As the scoop moves along the forward unloading path, its discharges the earth. The forward unloading path of the scoop is offset laterally from its rearward loading path so that earth is not discharged at the same location where the scoop was digging.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE PREFERRED EMBODIMENT

Figure 1:
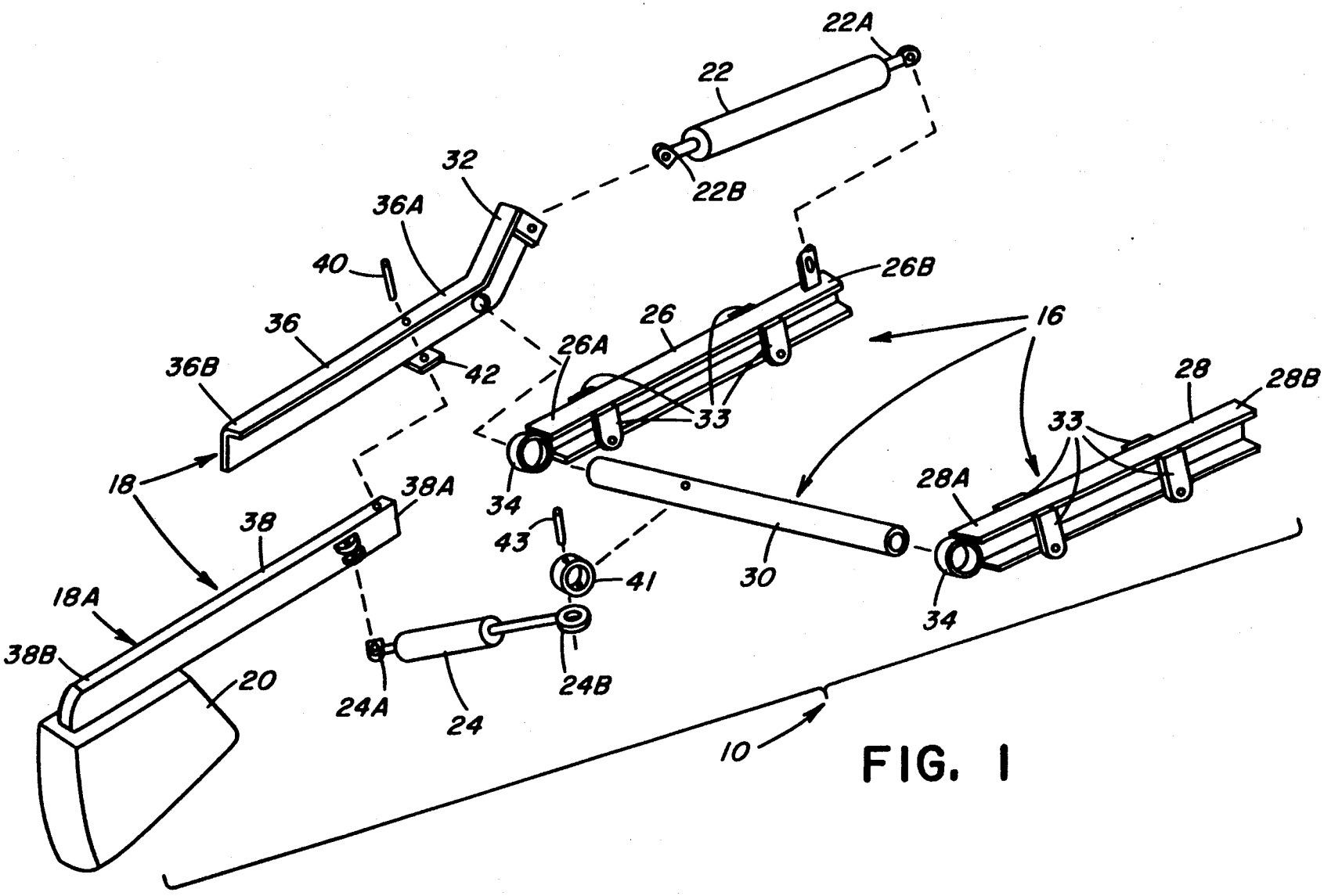
FIG. 1 is a perspective exploded view of a ditch hoe attachment of the present invention.
Figure 2:
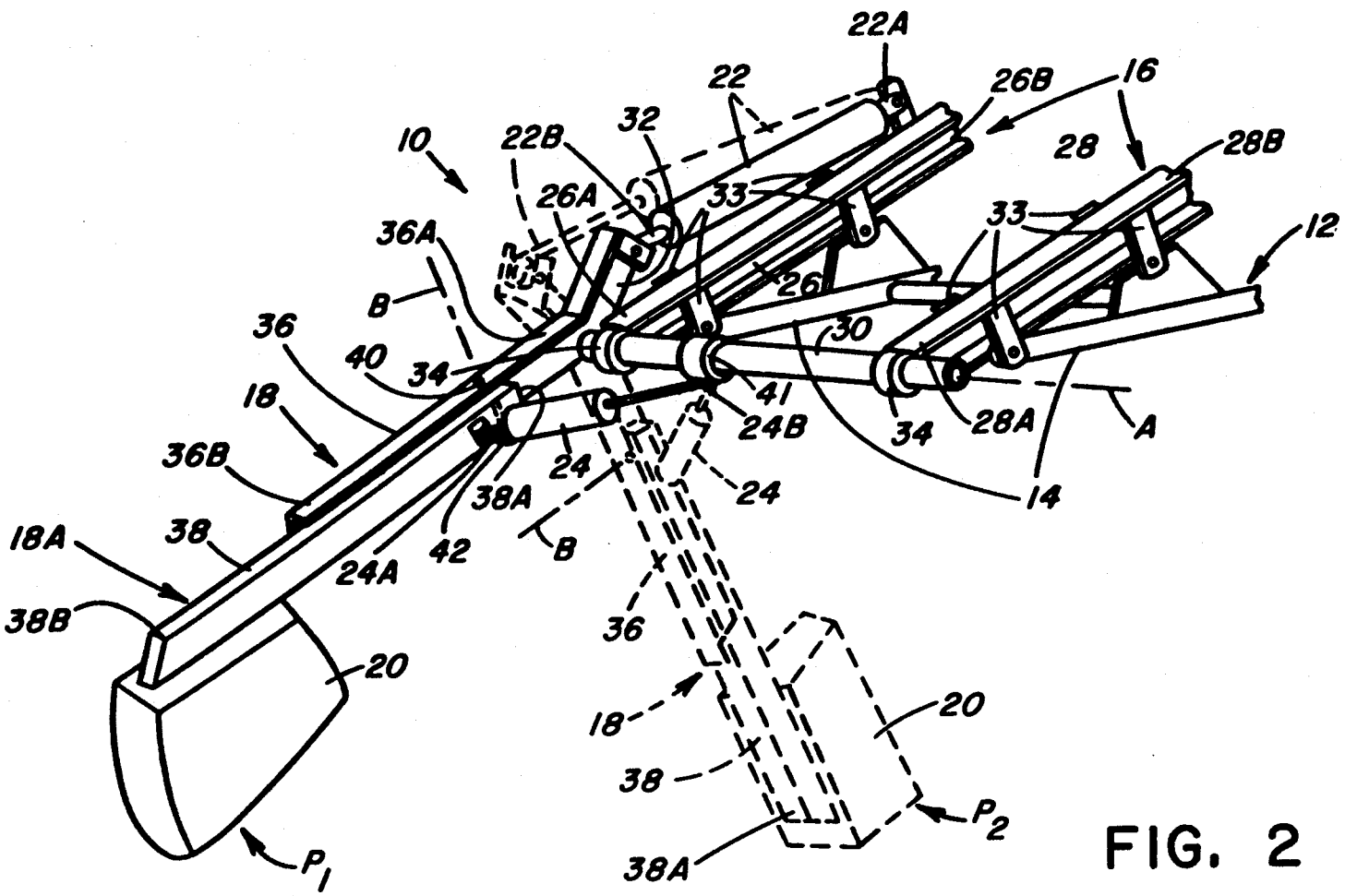
FIG. 2 is a perspective view of the ditch hoe attachment supported by the boom structure of a tractor-mounted front end loader. The hoe, as shown, is in its initial forward position (solid lines) and its rearward position (dashed lines).

Referring to the drawings, and particularly to FIGS. 1 and 2, there is illustrated a ditch hoe attachment, generally designated 10, of the present invention. As seen in FIG. 2, the ditch hoe attachment 10 can be employed on a conventional tractor-mounted front end loader 12. Particularly, the ditch hoe attachment 10 is supported at the forward end of a boom structure 14 of the front end loader 12 which extends along opposite sides and from the front of a tractor (not shown). In order to mount the ditch hoe attachment 10 on the boom structure 14 of the front end loader 12, a bucket (not shown) must first be removed.

Figure 3:
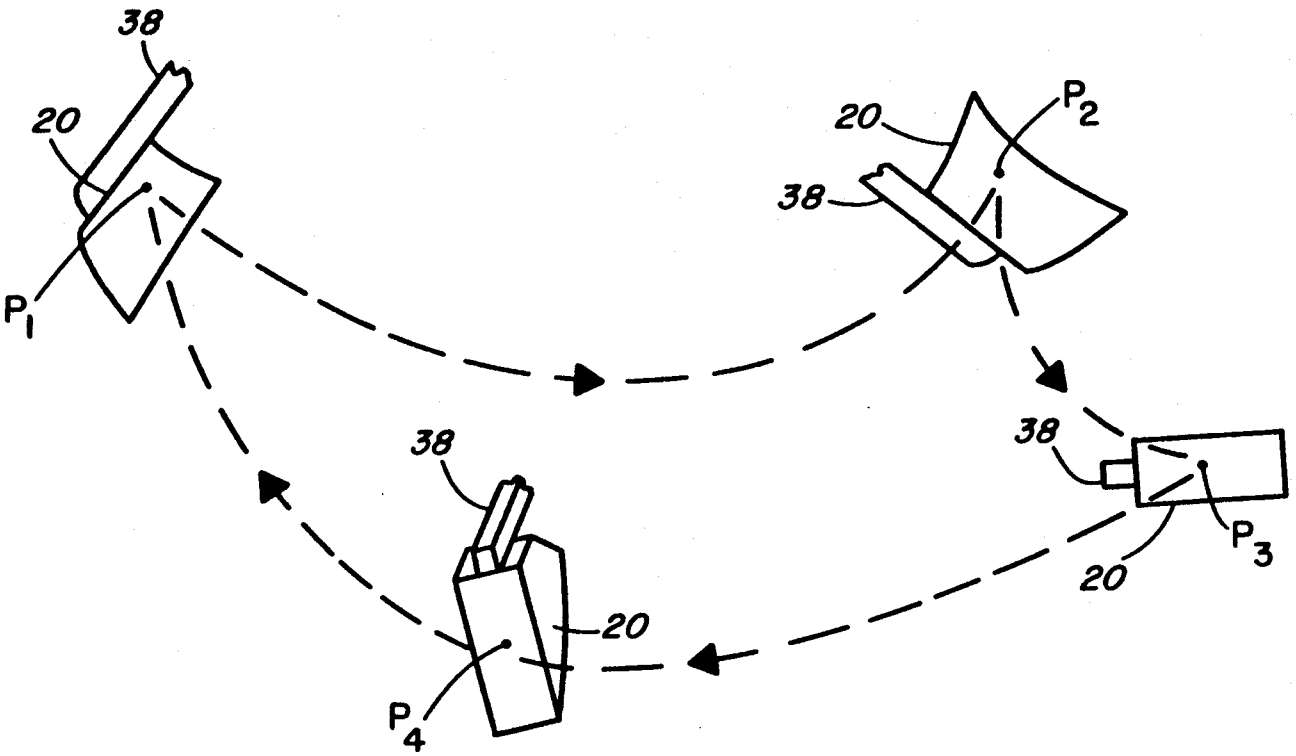
FIG. 3 is a diagrammatic representation of successive movement of the digging scoop of the ditch hoe attachment along a rearward working path and a forward return path taken from the left side of the end loader.

Referring again to FIGS. 1 and 2, the ditch hoe attachment 10 of the present invention basically includes an attaching frame 16, an elongated arm 18, a working tool such as an excavating or digging scoop 20, and first and second actuators 22, 24. The attaching frame 16 is attachable to the boom structure 14 of the front end loader 12. The elongated arm 18 is mounted for rotational movement relative to the attaching frame 16. The digging scoop 20 is rigidly attached to an outer end 18A of the arm 18. The first and second actuators 22, 24 are operable to cause movement of the arm 18 and thereby movement of the scoop 20, as depicted in FIG. 3, from an initial position through a rearward loading path in which the scoop digs the ground and fills with earth, and then through a forward unloading path, being laterally offset from the rearward loading path, in which the scoop discharges the earth and returns to the initial position.

More particularly, the attaching frame 16 of the ditch hoe attachment 10 include a pair of laterally-spaced right and left longitudinal main beams 26, 28, a front cross tube 30, and a crank lever 32. These components are preferably made of readily-available metal constructional materials.

The longitudinal main beams 26, 28 have I-shaped cross-sectional configurations and are each attached by pairs of fore-and-aft spaced tabs 33 to a forward end portion of the boom structure 14 of the front end loader 12. Aligned cylindrical hollow sleeves 34 are rigidly affixed to forward ends 26A, 28A of the respective right and left longitudinal main beams 26, 28 so as to define a first rotational axis A on the attaching frame 16 extending generally perpendicular to the longitudinal beams.

The cross tube 30 has a cylindrical shape with an outside diameter slightly less than the inside diameters of the hollow sleeves 34 adapting the cross tube 30 to mount through the sleeves 34 and extend transversely to the longitudinal beams 26, 28. In such manner, the cross tube 30 is mounted to the longitudinal beams 26, 28, via the sleeves 34 at the forward ends 26A, 28A thereof, for rotation about the first rotational axis A extending generally perpendicular to the main beams. The crank lever 32 is rigidly attached the right end of the cross tube 30 and extends therefrom in a radial relation from the first rotational axis A.

The elongated arm 18 of the ditch hoe attachment 10 includes separate elongated rear and front portions 36, 38. The rear portion 36 has right-angle configuration in cross-section, whereas the front portion 38 has a rectangular tubular configuration in cross-section. At a rear end 36A, the rear portion 36 of the elongated arm 18 is rigidly attached to the right end of the cross tube 30 of the attaching frame 16 and integrally connected to the crank lever 32. Thus, the rear portion 36 of the elongated arm 18 is mounted for undergoing rotational movement with the cross tube 30 and crank lever 32 about the first rotational axis A. While in the illustrated embodiment the elongated arm 18 and the crank arm 32 are shown as integrally connected components of a one-piece structure, it can be readily understood that they can also be separate components independently rigidly connected to the cross tube 30.

At a rear end 38A, the front portion 38 of the elongated arm 18 is rotatably mounted to the rear portion 36 of the elongated arm 18 at an intermediate location therealong between the rear end 36A and a front end 36B of the front portion 36 of the elongated arm 18. The front portion 38 is rotatably hinged or coupled at the inside of the cross-sectionally right angle-shaped rear portion 36 by a pivot pin 40. The pin 40 extends through the rear end 38A of the front portion 38 of the elongated arm 18 and between the rear portion 36 of the elongated arm 18 at the intermediate location therealong and a mounting tab 42 rigidly attached to and extending laterally from the intermediate location on the rear portion 36 of the elongated arm 18. The pivot pin 40 defines a second rotational axis B extending transverse or generally perpendicular to the first rotational axis A of the elongated arm 18.

The digging scoop 20 of the ditch hoe attachment 10 has a trapezoidal box-shaped configuration and is open at a side facing in generally rearwardly and downwardly direction when the scoop 20 is positioned for digging in the ground, as shown in solid line form in FIG. 2. The scoop 20 is rigidly attached along a rear side of the outer end portion 18A of the longitudinal arm 18, which also is the front end 38B of the pivotal front portion 38 of the arm 18. Thus, the scoop 20 is capable of digging into the ground and filling with earth.

The first actuator 22 of the ditch hoe attachment 10 is preferably a telescopic hydraulic actuator mounted between the right longitudinal beam 26 of the attaching frame 16 and the crank lever 32 thereof. Particularly, the first telescopic hydraulic actuator 22 is pivotally mounted at a cylinder end 22A to the rearward end 26B of the right longitudinal main beam 26 and at an opposite piston rod end 22B to the cross tube crank lever 32.

The first actuator 22 is operated, by manipulation of suitable hydraulic controls (not shown), to extend and retract through respective forward and reverse strokes. Extension of the first actuator 22 along the forward stroke causes the cross tube 30 and crank lever 32 and thereby the elongated arm 18 to rotate in one direction about the first rotational axis A, displacing the rear portion 36 of the elongated arm 18 (and the front portion 38 therewith) from a forward position shown in solid line form in FIG. 2 toward a rearward position. Retraction of the first actuator 22 along the reverse stroke causes the cross tube 30 and crank lever 32 and thereby the elongated arm 18 to rotate in a reverse direction about the first rotational axis A, displacing the rear portion 36 back toward the forward position.

The second actuator 24 of the ditch hoe attachment 10 also is preferably a telescopic hydraulic actuator mounted between the cross tube 30 of the attaching frame 16 and the front portion 38 of the elongated arm 18. In particular, the second telescopic hydraulic actuator 24 is pivotally mounted at a cylinder end 24A to the rear end 38A of the front portion 38 of the elongated arm 18 at a location spaced from the pivot pin 40. Also, the second actuator 24 is pivotally mounted at a piston rod end 24B to the cross tube 30 via a sleeve 41 attached to the cross tube 30 by a pin 43 at a location spaced from the right end of the cross tube.

The second actuator 24 is operated, by manipulation of suitable hydraulic controls (not shown), to retract and extend through respective forward and reverse strokes. Retraction of the second actuator 24 along the forward stroke causes the front portion 38 of the elongated arm 18 to rotate or pivot in one direction about the second rotation axis B relative to the rear portion 36 from a generally aligned position relative to the rear portion 36 of the elongated arm 18, as seen in solid line form in FIG. 2, to generally transverse position relative to the rear portion 36 of the elongated arm 18, as seen in dashed line form in FIG. 2. Extension of the second actuator 24 along the reverse stroke causes the front portion 38 of the elongated arm 18 to rotate or pivot in a reverse direction about the second rotational axis B relative to the rear portion 36 from the transverse position back to the aligned position. At its aligned position, the front portion 38 abuts the inside of the cross-sectionally right-angle shaped rear portion 36.

In moving toward its transverse position, the front portion 38 pivots along an arcuate path away from the rear portion 36. As seen in FIGS. 2 and 3, the digging scoop 20 moves with the front portion 38 of the elongated arm 18 between a vertical digging position in which the scoop 20 is spaced below the rear portion 36 of the elongated arm 18 and is capable of digging and filling with earth, and a lateral unloading position in which the scoop 20 is spaced laterally from a side of the rear portion 36 of the elongated arm 18 and capable of discharging the earth.

Figure 4:
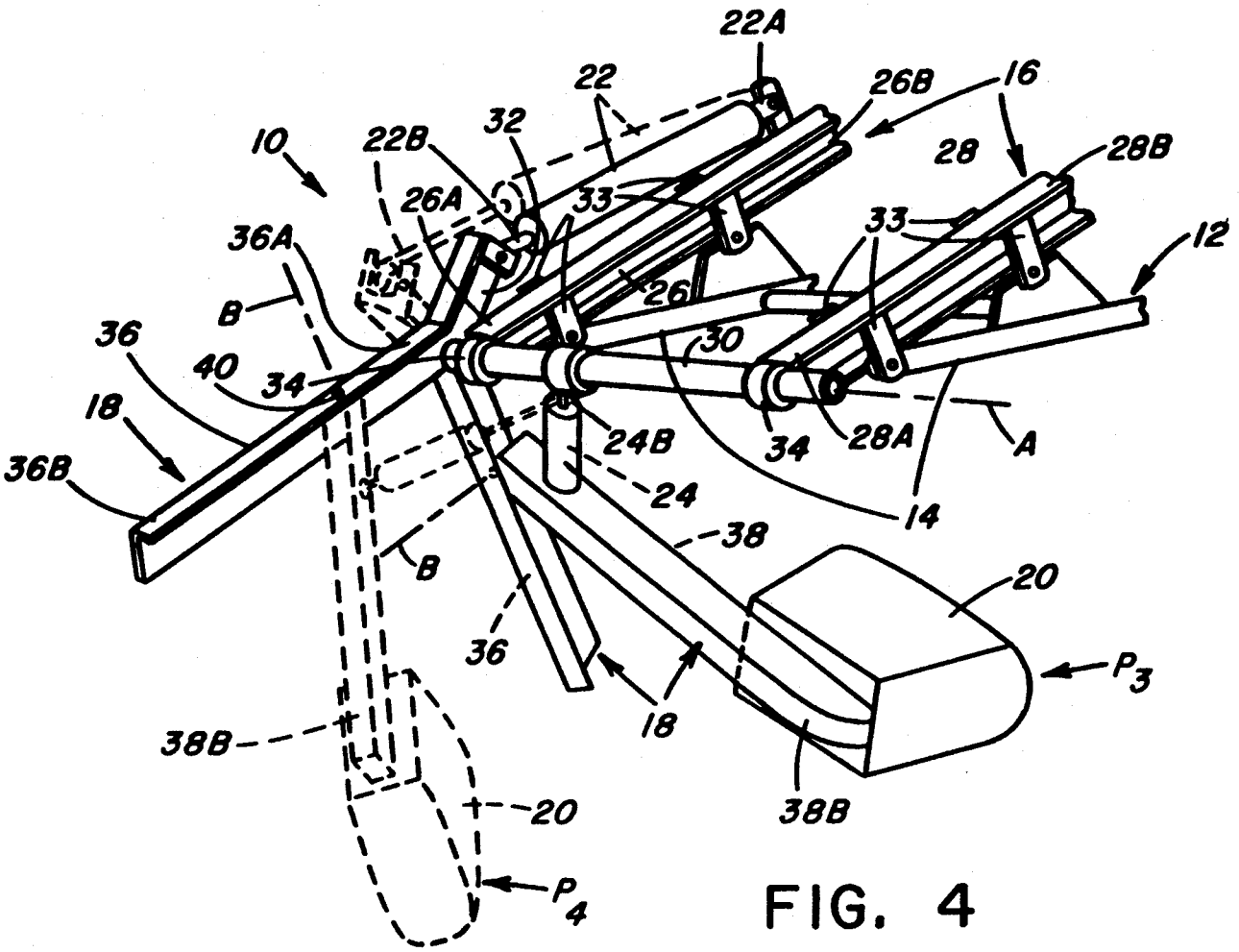
FIG. 4 is another perspective view of the ditch hoe attachment supported by the boom structure of a tractor-mounted end loader. The hoe, as shown, is in its lateral rearward position (solid lines) and its forward lateral position (dashed lines).

As mentioned earlier, the second rotational axis B of the front portion 38 of the elongated arm 18 is oriented in a generally transverse or perpendicular relation to the first rotational axis A of the cross tube 30 and the rear portion 36 of the arm 18. Due to such orientation of the first and second rotational axes A, B, as seen in FIG. 3, successive operation of the first and second actuators 22, 24 through their respective forward strokes will move the scoop 20, first, from an initial forward position $P_1$ above the ground along the arcuate rearward loading path to a rearward position $P_2$ above the ground, causing the scoop 20 to dig into the ground and fill with earth, and, second, from the rearward position $P_2$ along an arcuate lateral transfer path to a lateral rearward position $P_3$ (see FIG. 4) still above the ground, causing the scoop 20 to tilt or tip and initiate discharge of earth.

Then, successive reverse operation of the first and second actuators 22, 24 through their respective reverse strokes (see FIG. 4) will move the scoop 20, first, from the lateral rearward position $P_3$ along the arcuate forward unloading path to a forward lateral position $P_4$ still above the ground, causing the scoop 20 to invert and completely discharge the earth, and, second, from the forward lateral position $P_4$ along an arcuate reverse lateral transfer path back to the forward position $P_1$, causing the scoop 20 to reset to its digging orientation shown in solid line form in FIG. 2. The forward unloading path of the scoop 20 is offset laterally from its rearward loading path so that earth is not discharged at the same location where the scoop 20 was digging.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A ditch hoe attachment, comprising:

(a) an attaching frame having a mounting structure defining a first rotational axis and having a first member mounted to said mounting structure for rotation about said first rotational axis and a second member attached to said first member and extending therefrom in a radial relation to said first rotational axis;

(b) an elongated arm having separate rear and front portions, said rear portion being rigidly attached to said first member of said attaching frame for rotational movement of said elongated arm with said first member about said first rotational axis, said front portion being mounted to and supported by said rear portion of said elongated arm at an intermediate location along said rear portion between front and rear ends of said rear portion for rotational movement relative to said rear portion about a second rotational axis being oriented generally transverse to said first rotational axis;

(c) a scoop mounted to an outer end of said front portion of said arm and capable of digging into and filling with earth;

(d) a first actuator mounted to and extending between said mounting structure of said attaching frame and said second member thereof and being operable through respective forward and reverse strokes to rotate said first member, via said second member, and said elongated arm with said first member respectively from a forward position to a rearward position and back to said forward position; and (e) a second actuator mounted between said first member of said attaching frame and said front portion of said elongated arm and being operable through respective forward and reverse strokes to rotate said front portion of said elongated arm relative to said rear portion thereof respectively from an aligned position relative to said rear portion to a transverse position relative to said rear portion and back to said aligned position;

(f) said transverse orientation of said first and second rotational axes relative to one another and said operation of said first and second actuators through said respective forward strokes followed by said respective reverse strokes causing successive movement of said scoop from an initial position along a rearward loading path in which said scoop digs the ground and fills with earth and a forward unloading path, being laterally offset from said rearward loading path, in which said scoop discharges the earth and returns to said initial position.

2. The attachment of claim 1 wherein said mounting structure of said attaching frame includes:

a pair of laterally spaced longitudinal beams; and a pair of aligned sleeves attached to forward ends of said longitudinal beams so as to define said first rotational axis on said attaching frame.

3. The attachment of claim 2 wherein said first member of said attaching frame is a cross tube extending transversely to said longitudinal beams and rotatably mounted through said sleeves at said forward ends of said longitudinal beams for rotation about said first rotational axis.

4. The attachment of claim 1 wherein:

said first member of said attaching frame is a cross tube mounted for rotation about said first rotational axis; and said second member of said attaching frame is a crank lever rigidly attached to said cross tube and extending therefrom in radial relation to said first rotational axis.

5. The attachment of claim 4 wherein said first actuator is a telescopic actuator coupled at one end to said mounting structure of said attaching frame and coupled at an opposite end to said crank lever, said first actuator being extendable and retractable to cause rotation of said cross tube and thereby rotational movement of said elongated arm from said forward position to said rearward position and back to said forward position.

6. The attachment of claim 4 wherein said second actuator is a telescopic actuator coupled at one end to said cross tube and coupled at an opposite end to said front portion of said elongated arm, said second actuator being extendable and retractable to cause rotation of said front portion of said elongated arm about said second rotational axis relative to said rear portion thereof from said aligned position to said transverse position and back to said aligned position.

7. A ditch hoe attachment supportable by a boom structure of a front end loader on a tractor, said attachment comprising:

(a) an attaching frame including a mounting structure attachable to a boom structure of a front end loader and defining a first rotational axis, said frame also including a cross tube mounted to said mounting structure for rotation about said first rotational axis and a crank lever rigidly attached to said cross tube and extending therefrom in a radial relation to said first rotational axis;

(b) an elongated arm having separate rear and front portions, said rear portion being rigidly attached to said cross tube for rotational movement of said elongated arm with said cross tube about said first rotational axis, said front portion being mounted to and supported by said rear portion of said elongated arm at an intermediate location along said rear portion between front and rear ends of said rear portion for pivotal movement relative to said rear portion about a second rotational axis being oriented generally transverse to said first rotational axis of said cross tube;

(c) a scoop attached to an outer end of said front portion of said elongated arm, said scoop being capable of digging into and filling with earth;

(d) a first telescopic actuator pivotally mounted at opposite ends to and extending between said mounting structure of said frame and said crank lever and being operable through respective forward and reverse strokes to rotate said cross tube, via said crank lever, and said elongated arm with said cross tube from a forward position to a rearward position and back to said forward position; and (e) a second telescopic actuator pivotally mounted at opposite ends to and extending between said cross tube and said front portion of said elongated arm and being operable through forward and reverse strokes to rotate said front portion of said elongated arm relative to said rear portion thereof rom an aligned position relative to said rear portion to a traverse position relative to said rear portion and back to said aligned position;

(f) said transverse orientation of said first and second rotational axes relative to one another and said operation of said first and second actuators through said respective forward strokes causing movement of said scoop, first, from an initial forward position above the ground along an arcuate rearward loading path to a rearward position above the ground, causing said scoop to dig the ground and fill with earth, and, second, from said rearward position along an arcuate lateral transfer path to a lateral rearward position still above the ground, causing said scoop to tilt and initiate discharge of earth;

(g) said transverse orientation of said first and second rotational axes relative to one another and said operation of said first and second actuators through said respective reverse strokes causing movement of said scoop, first, from said lateral rearward position along an arcuate forward unloading path to a forward lateral position still above the ground, causing said scoop to invert and completely discharge the earth, and, second, from said forward lateral position along an arcuate reverse lateral transfer path back to said initial forward position, causing said scoop to reset to said initial position, said arcuate forward unloading path of said scoop being offset laterally from said arcuate rearward loading path thereof so that earth is not discharged at the same location where it was dug.

8. The attachment of claim 7 wherein said mounting structure of said attaching frame includes:

a pair of laterally spaced longitudinal beams; and a pair of aligned sleeves attached to forward ends of said longitudinal beams so as to define said first rotational axis on said attaching frame.

9. The attachment of claim 8 wherein said cross tube of said attaching frame extends transversely to said longitudinal beams and is rotatably mounted through said sleeves at said forward ends of said longitudinal beams for rotation about said first rotational axis.

10. A ditch hoe attachment supportable by a boom structure of a front end loader on a tractor, said ditch hoe attachment comprising:

(a) an attaching frame including a pair of longitudinal beams actuatable to a boom structure of a front end loader and defining a first rotational axis at forward ends of said longitudinal beams extending generally perpendicular to said beams, a front cross tube mounted to said forward ends of said longitudinal beams for rotation about said first rotational axis, and a crank lever rigidly attached to said cross tube and extending therefrom in a radial relation to said first rotational axis;

(b) an elongated arm having separate rear and front portions, said rear portion being rigidly attached to said cross tube for rotational movement with said cross tube about said first rotational axis, said front portion being mounted to and supported by said rear portion of said elongated arm at an intermediate location along said rear portion between front and rear ends of said rear portion for pivotal movement relative to said rear portion about a second rotational axis being oriented generally perpendicular to said first rotational axis of said cross tube;

(c) a scoop attached to an outer end of said front portion of said elongated arm, said scoop being capable of digging into and filling with earth;

(d) a first telescopic actuator pivotally mounted at opposite ends to and extending between one of said longitudinal beams of said frame and said crank lever and being extendable and retractable through respective forward and reverse strokes to rotate said cross tube, via said crank lever, and said elongated arm with said cross tube from a forward position to a rearward position and back to said forward position; and (e) a second telescopic actuator pivotally mounted at opposite ends to said extending between said cross tube and said front portion of said elongated arm and being retractable and extendable through forward and reverse strokes to rotate said front portion of said elongated arm relative to said rear portion thereof from an aligned position relative to said rear portion to a transverse position relative to said rear portion and back to said aligned position;

(f) said transverse orientation of said first and second rotational axes relative to one another and said operation of said first and second actuators through said respective forward strokes causing movement of said scoop, first, from an initial forward position above the ground along an arcuate rearward loading path to a rearward position above the ground, causing said scoop to dig the ground and fill the earth, and, second, from said rearward position along an arcuate forward transfer path to a lateral rearward position still above the ground, causing said scoop to tilt and initiate discharge of earth;

(g) said transverse orientation of said first and second rotational axes relative to one another and said operation of said first and second actuators through said respective reverse strokes causing movement of said scoop, first, from said lateral rearward position along an arcuate forward unloading path to a forward lateral position still above the ground, causing said scoop to invert and completely discharge the earth, and, second, from said forward lateral position along an arcuate reverse transfer path back to said initial forward position, causing said scoop to reset to said initial position, said arcuate forward unloading path of said scoop being offset laterally from said arcuate rearward loading path thereof so that earth is not discharged at the same location where it was dug.

11. The attachment of claim 10 wherein said attaching frame includes a pair of aligned sleeves attached to forward ends of said longitudinal beams so as to define said first rotational axis on said attaching frame.

12. The attachment of claim 11 wherein said cross tube of said attaching frame extends transversely to said longitudinal beams and is rotatably mounted through said sleeves at said forward ends of said longitudinal beams for rotation about said first rotational axis.

* * * * *